US005406883A

United States Patent [19]

Schnell et al.

[11] Patent Number: 5,406,883

[45] Date of Patent: Apr. 18, 1995

[54] DEWATERING PRESS FOR COMPRESSIBLY DEWATERABLE MATERIAL

[75] Inventors: Hans Schnell, Mengen; Armin Volk, Weingarten, both of Germany

[73] Assignee: Sulzer Escher Wyss GmbH, Ravensburg, Germany

[21] Appl. No.: 45,856

[22] Filed: Apr. 9, 1993

[30] Foreign Application Priority Data

| | | | |
|---|---|---|---|
| Apr. 11, 1992 | [DE] | Germany | 42 12 275.9 |
| Sep. 11, 1992 | [DE] | Germany | 42 30 383.4 |
| Sep. 11, 1992 | [DE] | Germany | 42 30 384.2 |
| Sep. 11, 1992 | [DE] | Germany | 42 30 385.0 |

[51] Int. Cl.[6] ..... B30B 9/18

[52] U.S. Cl. ..... 100/126; 100/117; 100/148; 100/149

[58] Field of Search ..... 100/117, 126, 127, 145–150, 100/191, 192, 37, 138, 139, 140, 116, 232, 264, 244

[56] References Cited

U.S. PATENT DOCUMENTS

| | | | |
|---|---|---|---|
| 2,260,865 | 10/1941 | Peterson . | |
| 2,615,387 | 10/1952 | Messing | 100/148 X |
| 3,073,239 | 1/1963 | Cowan et al. | 100/179 |
| 3,121,387 | 2/1964 | Fuhrwerk et al. | 100/192 X |
| 3,550,526 | 12/1970 | Hoover | 100/37 |
| 3,715,977 | 2/1973 | Mackenzie | 100/117 |
| 3,789,752 | 2/1974 | Wirz | 100/192 X |
| 4,016,988 | 4/1977 | Dahlin | 100/264 X |
| 4,044,569 | 8/1977 | Harza | 100/192 X |
| 4,165,283 | 8/1979 | Weber et al. | 100/116 X |
| 4,256,035 | 3/1981 | Neufeldt | 100/145 |

FOREIGN PATENT DOCUMENTS

| | | | |
|---|---|---|---|
| 0037041 | 10/1981 | European Pat. Off. . | |
| 0211706 | 3/1987 | European Pat. Off. . | |
| 0219785 | 4/1987 | European Pat. Off. . | |
| 376833 | 8/1907 | France . | |
| 1275477 | 10/1961 | France | 100/148 |
| 1494284 | 9/1967 | France . | |
| 52-18262 | 2/1977 | Japan | 100/116 |
| 91/06422 | 5/1991 | WIPO . | |

*Primary Examiner*—Stephen F. Gerrity
*Attorney, Agent, or Firm*—Townsend and Townsend Khourie and Crew

[57] ABSTRACT

A process is proposed for the dewatering of compressibly dewaterable materials, in particular waste from the processing of paper material, which enables a very high degree of dewatering so that the waste can be readily disposed of, e.g. dumped. For this purpose, the material to be dewatered is initially pre-dewatered by gravity, and usually also by compression, in a transportation section (5). This pre-dewatering can take place in a continually operating feed section (7) through a perforated sieve jacket (10). The material then reaches a press section (6) in which a discontinuously working pressing device is in operation. Further improvements in the dewatering performance are possible by various embodiments of the corresponding pressing elements (13,14). The invention relates to both the process and the device for implemention of the process.

27 Claims, 4 Drawing Sheets

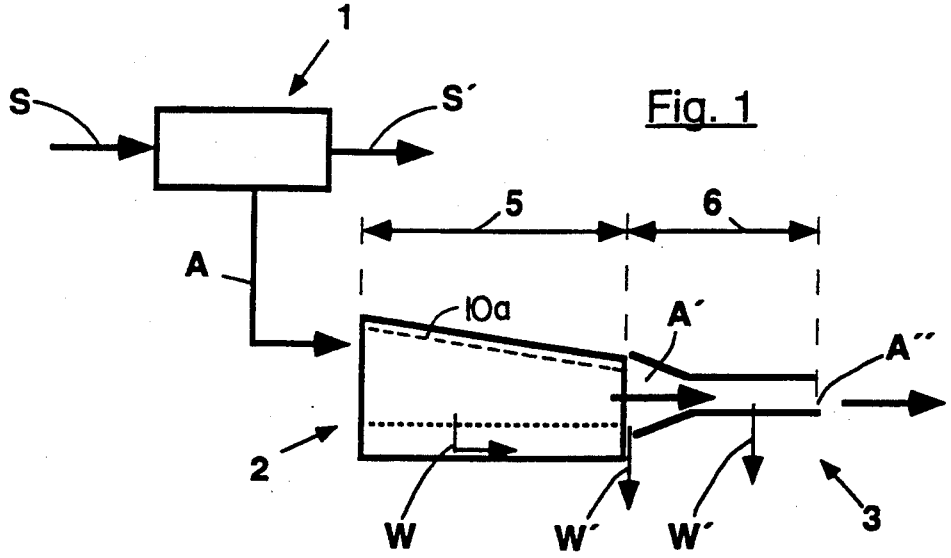
Fig. 1
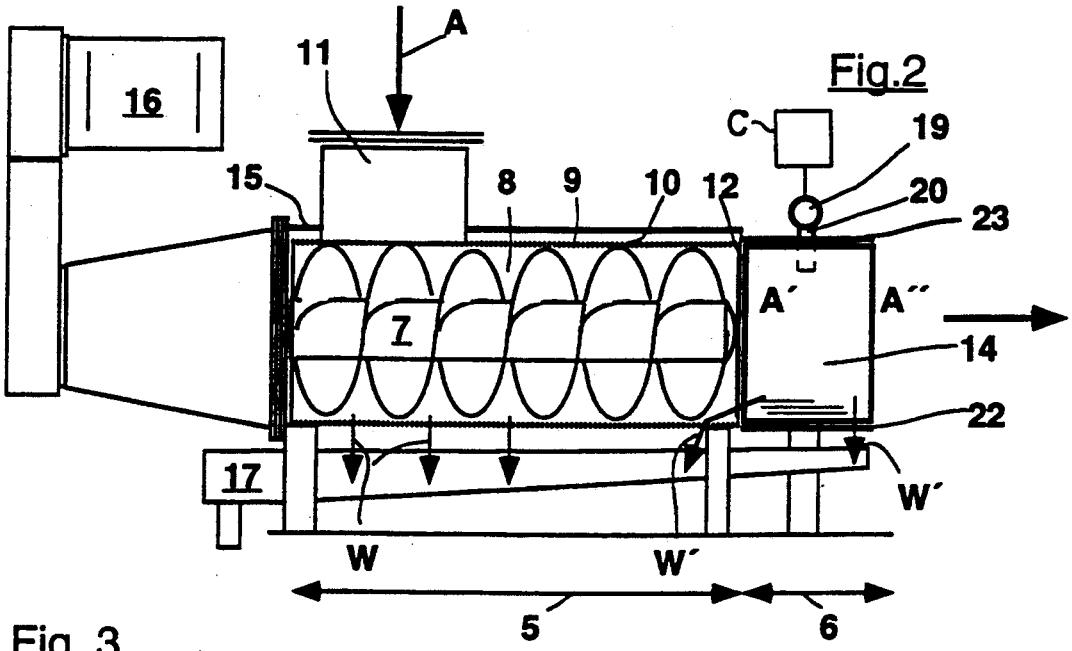
Fig.2
Fig. 3
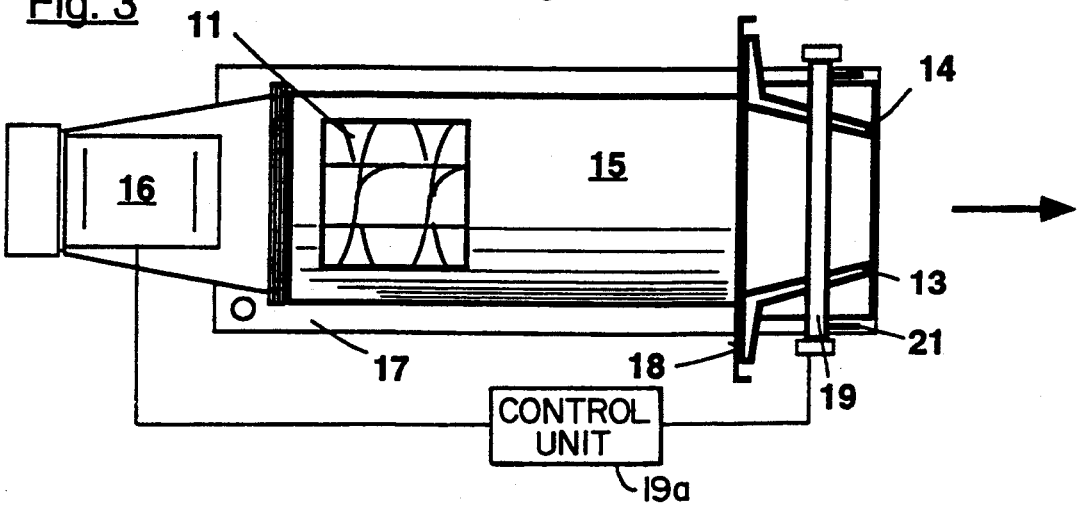

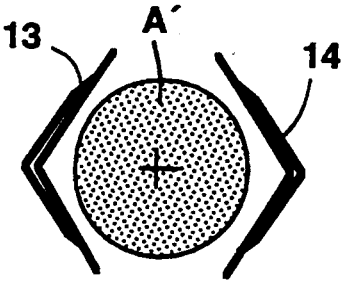
Fig. 4a
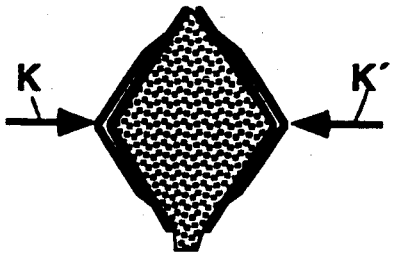
Fig. 4b
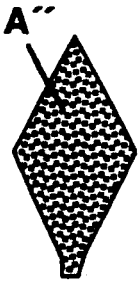
Fig. 4c
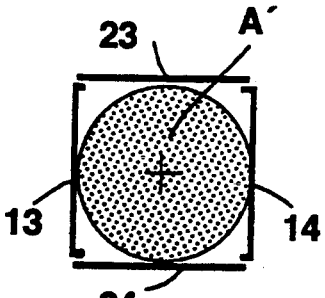
Fig. 5a
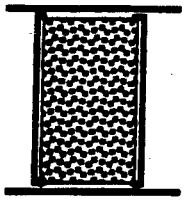
Fig. 5b
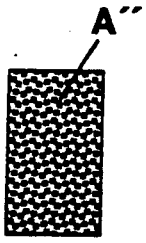
Fig. 5c
Fig. 6a
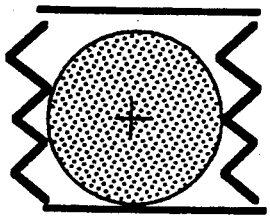
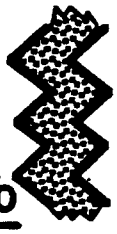
Fig. 6b
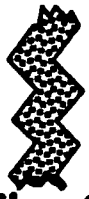
Fig. 6c
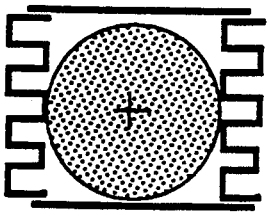
Fig. 7a
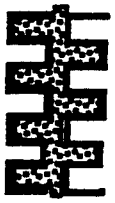
Fig. 7b
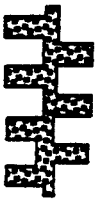
Fig. 7c Fig. 8
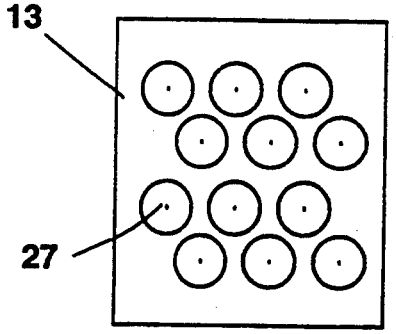
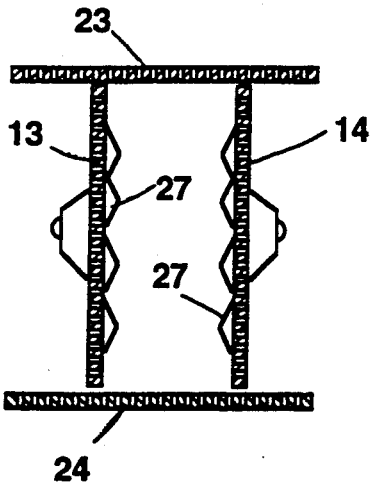
Fig.9
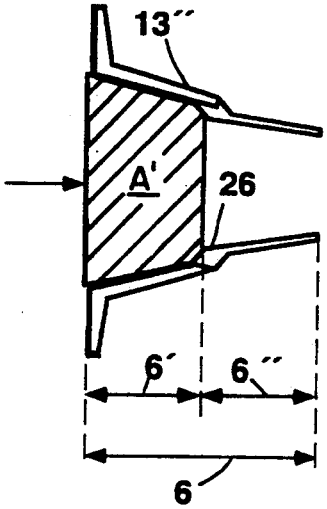
Fig. 10a
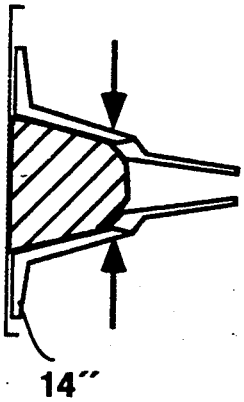
Fig. 10b
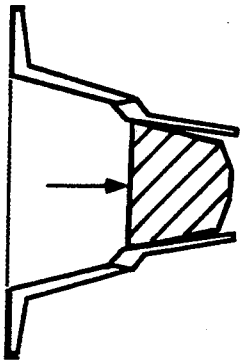
Fig. 10c
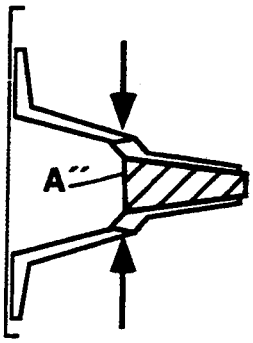
Fig. 10d
Fig.11
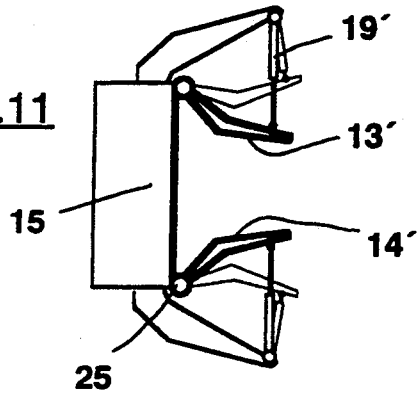

DEWATERING PRESS FOR COMPRESSIBLY DEWATERABLE MATERIAL

FIELD OF INVENTION

The invention relates to a dewatering press for compressibly dewaterable material which contains a feed device defining a feed section, which is disposed in a volume having an opening for the material in-feed, through which the material to be dewatered can reach the initial region of the feed section. The volume is partially bounded by a jacket provided with a plurality of openings, through which the water contained in the material to be dewatered can pass, while a substantial part of the material present as solid material is held back. This material is then compacted and partially dewatered. Additionally, the press further contains a material discharge device lying at the end of the feed section.

The operation of a dewatering press of this kind will be described in the following with reference to the example of waste obtained in the processing of used paper, but is also applicable to other compressibly dewaterable material.

TECHNICAL BACKGROUND

As is known, used or waste paper usually contains a certain proportion of unwanted stock or material which should be removed by processing for the purpose of the recycling of used paper. For this, a number of machines and processes are available to draw off as accepted stock the used paper, which is to be further processed, while the unwanted stock is removed therefrom as reject material. These reject materials are normally disposed of or, also, in special cases, reprocessed into new products. Since used paper processing normally takes place in aqueous suspension, the reject materials contain much water which makes them difficult to manipulate, and which considerably increases the transport and dumping costs for their disposal.

The mechanical separation of the water from the material by pressing has proved itself to be an economically viable and practical process. Consequently, for instance, worm or screw presses are used in which a driven feed screw is arranged inside of a substantially concentric cylindrical or conical, perforated sheet metal jacket or the like. The reject material is fed in radially and is dewatered in cooperation with a dam apparatus, wherein the water can escape through the perforated sheet metal jacket or the like, whereas the reject materials are held back. The compression and dewatering of the reject can be improved when a conical form is chosen for the sheet metal jacket, the diameter of which reduces in the direction of movement of the reject material. Naturally, the outer worm diameter must also fit these geometrical dimensions. When the known dewatering worms are implemented as described, they are subject to a particularly large wear as a result of intensive rubbing between reject materials and the components of the machine. Namely, a considerable relative movement occurs under simultaneously enormous axial and radial forces between the already much thickened material and the components. Moreover, this reject material contains often many small metal particles and pieces of hard plastic, as well as fiber remnants which, as is known from practice, can lead to a high wear even of high quality metallic components.

PRINCIPAL OBJECT OF THE INVENTION

An object of the present invention is to form a dewatering press for compressibly dewaterable materials in such a way that a high degree of dewatering is achievable, and simultaneously that excessive wear on the machines carrying out the process is avoided. This should also be possible when the material which is to be dewatered consists of waste obtained in the processing of used paper material.

BRIEF DESCRIPTION OF THE INVENTION

This object of the invention is satisfied in a dewatering press of the above named kind in that, pressing elements are provided in the region of the material discharge device and extend over an adjoining press section in the feed direction, into which the material at the end of the feed section can enter and pass through, wherein a passage cross-section is formed between the pressing elements which can be made larger or smaller by moving at least one of the pressing elements.

Very high forces can be exerted on the material without problem due to the fact that, in the device in accordance with the invention, the press treatment is not a steady state process, but rather an intermittent process. Only slight relative movements occur between the material and the components which transmit the pressing force onto the material. If the pressing movement occurs perpendicular to the direction of the initial feed, the material is confined and is very strongly compressible, without a disadvantageously high force being transmitted onto the components which effect the initial feed.

BRIEF DESCRIPTION OF THE DRAWINGS

FIG. 1 is a functional diagram of the subject of the invention,

FIG. 2 is a schematic cross-section of the subject of the invention,

FIG. 3 is a plan view of the device shown in FIG. 2,

FIGS. 4*a*–4*c* are schematic diagrams of the course of the press treatment, FIGS. 5*a*–5*c* are schematic representations illustrating the progress of the material compression, FIGS. 6*a*–6*c* are schematic representations illustrating the progress of another material compression, FIGS. 7*a*–7*c* are schematic representations of the progress of yet another manner of compressing the material, FIG. 8 is a front elevational view of a pressing element constructed in accordance with the present invention, FIG. 9 is a side elevational view of the pressing element shown in FIG. 8, FIGS. 10*a*–10*d* are schematic representations of a further pressing device with projections, FIG. 11 is a schematic representation of a further pressing device with hinges.

DESCRIPTION OF PREFERRED EMBODIMENTS

Figure 12:
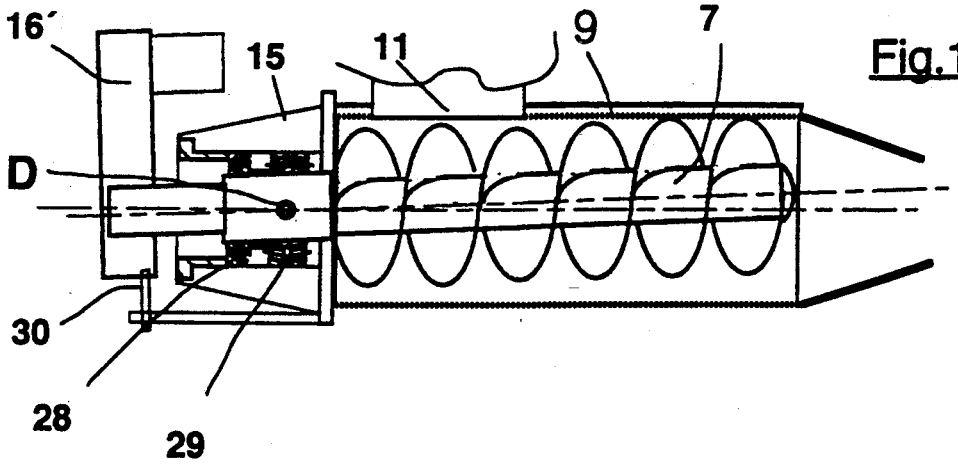
FIG. 12 is a schematic representation of the subject of the invention with a tilted screw.

FIG. 1 shows in a diagram the individual functions which can be fulfilled by the device in accordance with the invention. In the example represented here, used or waste paper material S is being processed in the processing 1, wherein waste is obtained while the processed material S', which is at least partially cleansed of the waste, is fed on further. The waste in the form of the material A which is to be dewatered reaches a feed 2 with a feed section 5. Water W is removed from the waste as a result of gravity and usually also by compression. The material A' dewatered in this way is subsequently subjected to press treatment 3 in the press section 6 and is still more heavily dewatered under release of further water W' and is fed out as plug-like material A".

FIG. 2 shows a press device constructed in accordance with the invention. In the case shown here, a transport screw is used as the feeding device 7. The material A passes through an opening 11 into the volume 8 in which the transport screw is present. The volume 8 is bounded by a jacket 10 provided with holes 9, the jacket 10 being constructed cylindrically here. FIG. 1 illustrates a conically shaped jacket 10*a*. The material is already pre-dewatered by passing through the feed section 5, not only by gravity, but also by any compression which may occur during the transport. During this, the water W runs through the openings 9 of the jacket 10 into the dewatering container 17. After having passed through the feed section 5, the material reaches the region of the discharge 12.

In the now following press section 6, the press elements 13 and 14 disposed between an upper and a lower plate 23 and 24 respectively come into operation. In the case shown here, they are movable perpendicular to the feed direction of the transport screw in guides 18 and are periodically pressed against the material A' by positioning motors 19. A control unit 19*a*, shown in FIG. 3, controls the movement of at least one of the press elements 13, 14 in dependence on the drive moment of the feed device 7 so that the magnitude of the drive moment can be kept within a given range. The positioning motor, which is for example hydraulically actuated, is supplied with a pressure medium via stub pipes 21. As a result of the pressing, further water W' passes into the dewatering container 17. Naturally, positioning motors in accordance with FIG. 11 or other devices for the production of pressing force are also conceivable. The material A", which is now very strongly dewatered, can fall out of the device or is pushed out by the material following it. The transport screw is driven by a drive motor 16 which, as schematically indicated, sets the shaft of the transport screw in rotation via a belt or the like.

This same pressing device is shown in FIG. 3, with the upper plate 23 being absent and view from above, with view onto the housing 15 and the in-flow opening 11.

FIGS. 4*a*–4*c* show in rough schematic representation the reforming of the compressed material A' into the pressed out plug-like material A". The drawing FIGS. 4*a*–4*c* show the course of the pressing process, (a): unpressed, the pressing elements 13 and 14 are moved up to the waste A'; (b): the waste is pressed with the aid of relatively large forces K and K', and becomes in accordance with (c) re-formed and compressed plug.

The transformation of a circular cross-section compacted material to one with elongated cross-section results in a re-formation of the entire plug, which means a substantial improvement of the dewatering possibilities. Thereby, the relative position of adjacent regions in the material which is to be pressed is changed and the fitting together into a compact pressed object made considerably easier which, in turn, improves the dewatering performance for the same expenditure of force. Examples of this are sketched in FIGS. 5*a* through 7*c* without this selection being complete.

A further improvement of the effect is brought about in accordance with FIG. 8 by raised portions 27 on the pressing element 13, which are in this case implemented as cones, and which are provided with holes (not shown). They are disposed on the side facing towards the material which is to be pressed and are pressed into this during the pressing process. In this way, the path for the water is shortened in an advantageous manner. FIG. 9 shows the arrangement with this type of press elements 13 and 14 provided together with the upper (23) and lower (24) plates in section.

As FIG. 10 shows, the press elements 13", 14" can be so formed that they can process the material A' which is to be pressed, particularly intensively in many individual steps. For this reason, the press section 6 is shown divided into partial press sections 6' and 6". After having been pressed in the partial press section 6', the material passes into the partial press section 6" by the pushing of following material, which is not shown, after the pressing elements have been reopened. A further heavy compression and dewatering then follows. By repeated opening of the pressing element, the plug, which is still compressed, can fall out or be pressed out by the material following. The shoulder 26 can advantageously amplify the effect, but is not necessary. Naturally, further partial press sections, which are not shown, could also be connected. The openings in the pressing elements, which are not shown here, could be chosen to be bigger where the material is pressed harder for better water removal, because the then more heavily compressed plug has less tendency to press into the holes and to so block them up.

FIG. 11 represents schematically a further embodiment is which the pressing elements 13' and 14' are pivotably mounted to the housing 15 by hinges 25, and can be moved by the positioning motors 19'. The open position is shown by thinner lines than the pressing position.

In FIG. 12 a sectional side view, which is somewhat exaggerated for clarity, represents the pivoting movement of the feed screw 7 together with the drive unit 16'. The pivotal point D for this rotary pendular movement lies axially considered, in the region of the screw mounting. The bearings 28 and 28 shown there can take up both the axial forces and the radial forces at this point, wherein, however, the possibility of the screw axis to perform a rotary pendular movement is retained. The drive unit 16' is supported substantially by the described bearing arrangement, since it is connected with the drive side end of the feed screw 7. The angular moment originating from the drive force is transmitted to the housing 15 of the press via the torque stay 30. By appropriate construction of the machine, the lever moments originating from the gravity forces of the feed screw 7 and the drive unit 16' can be substantially balanced at the bearings 28 and 29.

Figure 13:
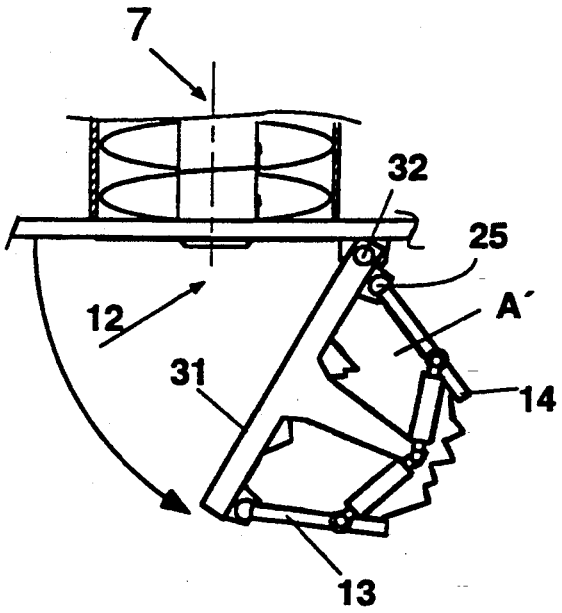
FIG. 13 is a schematic representation of the subject of the invention with a downwardly swung discharge device.

FIG. 13 shows, in a simplified representation, an opened discharge device. For the representation a view from above was chosen. The discharge device contains a frame 31 which is openably and closeably secured in hinges 32 at parts of the housing 15 of the dewatering press. This frame 31 carries hinges 25 which serve to secure the pressing elements 13, 14, which are shown in simplified form, so that they can be moved relative to the frame 31.

If the discharge device is closed when the dewatering press is not in use, the end of the feed screw 7 is relatively easily accessible, while the plug A' can stay in the up-pivoted discharge device. For instance after successful servicing of the dewatering press, the discharge device can be opened once more and the operation of the dewatering screw once more initiated. As the plug A' is once more at its old position, the optimum operating condition of the dewatering press is relatively quickly achieved.

Even though only apparatuses with horizontally lying feed and press sections have been shown here, vertically or inclined arrangements are also directly conceivable, under conditions even advantageous. Furthermore, the number of pressing elements used for the pressing process need not be limited to two.

What is claimed is:

1. A two-stage apparatus for dewatering wet material including solids and water, the apparatus comprising:

an axially extending first dewatering stage including means generating a material advancing force applied to the material in the first stage for advancing the material along a longitudinal axis and a water-pervious jacket extending at least partially about the advancing means, the advancing means and the jacket cooperating with each other to effect a compaction and partial dewatering of the material while the material is in the first dewatering stage;

a second dewatering stage downstream of and in communication with the first dewatering stage so that material which has been advanced through the first stage enters the second stage, the second stage including first and second pressing elements adapted to receive material from the first stage and means for intermittently moving the pressing elements relative to each other in a direction transverse to the longitudinal axis against the material disposed in the second stage to thereby dewater the material in the second stage with compression forces generated by the pressing elements and independently of dewatering forces generated by the advancing means and applied to the material in the first stage; and control means responsive to the material advancing force for initiating movement of the pressing elements relative to each other and against the material in the second stage when the material advancing force reaches a predetermined magnitude.

2. Apparatus according to claim 1 wherein the pressing elements are movable in a direction substantially perpendicular to the longitudinal axis.

3. Apparatus according to claim 1 including means for applying a force to the pressing elements to generate the compression forces.

4. Apparatus according to claim 1 including means for moving the pressing elements relative to the longitudinal axis.

5. Apparatus according to claim 1 wherein the advancing means comprises a screw conveyor, and wherein the sensing means is responsive to a drive moment applied to the screw conveyor for generating the material advancing force.

6. Apparatus according to claim 1 wherein the advancing means comprises a screw conveyor.

7. Apparatus according to claim 6 wherein the first stage comprises an intake end and a discharge end, wherein the screw conveyor extends from the intake end towards the discharge end, and including means rotatably mounting the screw conveyor proximate the intake end only.

8. Apparatus according to claim 6 including a drive motor for the screw conveyor, and means operatively coupling the drive motor to the screw conveyor and means mounting the drive motor and the screw conveyor and permitting relative pivotal movement of the drive motor and the screw conveyor about a pivot axis which is perpendicular to the longitudinal axis.

9. Apparatus according to claim 1 wherein the jacket comprises a cylindrical sheet metal sieve.

10. Apparatus according to claim 1 wherein the jacket comprises a conically shaped sheet metal sieve.

11. Apparatus according to claim 1 wherein the pressing elements comprise at least two components and including guides for moving the components relative to the longitudinal axis direction so that the components can be moved toward and away from the material in the second stage, the components being shaped to enclose the material in the second stage when moved against it and to release the material in the second stage when moved away therefrom.

12. Apparatus according to claim 1 wherein the second stage includes means defining a chamber comprising the pressing elements for receiving material from the first stage, and means for hingeably moving the chamber including the pressing elements and material disposed therein away from a discharge end of the first stage to thereby provide access to the first stage.

13. Apparatus according to claim 12 wherein the pressing elements are adapted to change a volume of the material in the second stage when the elements are moved relative to each other, and wherein the pressing elements further include means for changing their cross-sectional configuration.

14. Apparatus according to claim 13 wherein the first stage includes means for providing the material being conveyed to the second stage with a substantially circular cross-section, and wherein the pressing elements include means for changing the cross-section of the material in the second stage into a polygonal cross-section.

15. Apparatus according to claim 1 including a housing, wherein the first stage is disposed in the housing, wherein the pressing elements comprise at least two components, and including hinges mounting the components to the housing for pivotal movement of the components towards and away from the longitudinal axis so that pivotal movement of the components towards the longitudinal axis compresses the material in the second stage and pivotal movement of the components away from the longitudinal axis releases the material disposed between them for discharge from the apparatus.

16. Apparatus according to claim 15 including a frame mounting the hinges, and including means hingeably attaching the frame to the housing for moving the at least two components, and any material disposed between them, away from a discharge end of the first stage.

17. Apparatus according to claim 1 wherein the pressing elements include openings permitting the passage of water through them.

18. Apparatus according to claim 17 wherein the openings have a size which increases in a feed direction of the material.

19. Apparatus according to claim 17 wherein the pressing elements include projections extending towards the material in the second stage, and wherein the openings are formed in the projections.

20. Apparatus according to claim 19 wherein the projections are tapered and converge from the pressing elements towards the material in the second stage.

21. Apparatus according to claim 1 wherein the means for intermittently moving includes a motor for moving at least one pressing element.

22. Apparatus according to claim 21 wherein the first and second pressing elements are located opposite each other and straddle the longitudinal axis, and wherein the means for intermittently moving includes first and second motors applying oppositely directed forces to the first and second pressing elements, respectively, to therewith dewater the material in the second stage.

23. Apparatus according to claim 21 including control means operatively coupled with the motor for time-dependently controlling movement of the at least one pressing element.

24. A batch-type dewatering press comprising:

a concavely shaped, water-pervious sieve defining an intake and an outlet;

a screw conveyor disposed in the sieve for moving material including water and solids along a longitudinal axis from the intake to the outlet, whereby the material is partially dewatered as a result of gravity and its movement by the screw conveyor as it passes from the intake to the outlet;

first and second jaws spaced from the longitudinal axis and disposed downstream of the outlet for receiving material discharged through the outlet, the jaws defining a compression chamber between them; and means for intermittently moving at least one of the jaws transversely to the longitudinal axis towards the other jaw when a predetermined quantity of the material is in the chamber to thereby compress the material in the chamber with forces acting substantially perpendicular to the longitudinal axis;

whereby the compression of the material in the chamber by the jaws is independent of the screw conveyor to reduce forces acting on and wear of the jacket and the screw conveyor.

25. A two-stage apparatus for dewatering wet material including solids and water, the apparatus comprising:

an axially extending first dewatering stage including means for advancing the material along a longitudinal axis and a water-pervious jacket extending at least partially about the advancing means, the advancing means and the jacket cooperating with each other to effect a compaction and partial dewatering of the material while the material is in the first dewatering stage;

a second dewatering stage downstream of and in communication with the first dewatering stage so that material which has been advanced through the first stage enters the second stage, the second stage including means defining a chamber and comprising first and second pressing elements adapted to receive material from the first stage and means for intermittently moving the pressing elements relative to each other in a direction transverse to the longitudinal axis against the material disposed in the second stage to thereby dewater the material in the second stage with compression forces generated by the pressing elements and independently of dewatering forces generated by the advancing means and applied to the material in the first stage; and means for hingeably moving the chamber including the pressing elements and material disposed therein away from a discharge end of the first stage to thereby provide access to the first stage.

26. Apparatus according to claim 25 wherein the advancing means generates a material advancing force applied to the material in the first stage, and including control means responsive to the material advancing force for initiating movement of the pressing elements relative to each other and against the material in the second stage when the material advancing force reaches a predetermined magnitude.

27. A two-stage apparatus for dewatering wet material including solids and water, the apparatus comprising:

a housing;

an axially extending first dewatering stage disposed in the housing and including means for advancing the material along a longitudinal axis and a water-pervious jacket extending at least partially about the advancing means, the advancing means and the jacket cooperating with each other to effect a compaction and partial dewatering of the material while the material is in the first dewatering stage; and a second dewatering stage downstream of and in communication with the first dewatering stage so that material which has been advanced through the first stage enters the second stage, the second stage including first and second pressing elements adapted to receive material from the first stage and means for intermittently moving the pressing elements relative to each other in a direction transverse to the longitudinal axis against the material disposed in the second stage to thereby dewater the material in the second stage with compression forces generated by the pressing elements and independently of dewatering forces generated by the advancing means and applied to the material in the first stage, the pressing elements comprising at least two components, and including hinges mounting the components for pivotal movement of the components towards and away from the longitudinal axis so that pivotal movement of the components towards the longitudinal axis compresses the material in the second stage and pivotal movement of the components away from the longitudinal axis releases the material disposed between them for discharge from the apparatus, a frame mounting the hinges, and means hingeably attaching the frame to the housing for moving the at least two components, and any material disposed between them, away from a discharge end of the first stage.

* * * * *